US006062957A

United States Patent [19]

Klaft et al.

[11] Patent Number: 6,062,957

[45] **Date of Patent: *May 16, 2000**

[54] DRY ABRASIVE BLASTING HEAD HAVING ROTATING NOZZLES

[75] Inventors: Edwin D. Klaft, Santa Maria; Daniel Freitas, Manteca; Paul K. Davis, Auburn, all of Calif.

[73] Assignee: Pacific Roller Die Company, Inc., Hayward, Calif.

[ * ] Notice: This patent issued on a continued prosecution application filed under 37 CFR 1.53(d), and is subject to the twenty year patent term provisions of 35 U.S.C. 154(a)(2).

[21] Appl. No.: 08/965,078

[22] Filed: Nov. 6, 1997

Related U.S. Application Data

[63] Continuation-in-part of application No. 08/828,139, Mar. 24, 1997, abandoned, which is a continuation of application No. 08/423,970, Apr. 18, 1995, abandoned.

[51] Int. Cl.[7] ..... B24C 5/04

[52] U.S. Cl. ..... 451/102; 451/101

[58] Field of Search ..... 239/119, 124, 239/126, 127; 451/76, 90, 102, 61, 91, 99, 101

[56] References Cited

U.S. PATENT DOCUMENTS

| | | | |
|---|---|---|---|
| 2,358,557 | 9/1944 | Boyd et al. . | |
| 3,127,706 | 4/1964 | Giffen | 451/76 |
| 3,137,974 | 6/1964 | Kirkland | 451/76 |
| 4,180,948 | 1/1980 | Stoltz | 451/76 |
| 4,314,427 | 2/1982 | Stoltz | 451/76 |
| 4,557,079 | 12/1985 | Sheesley | 451/76 |
| 4,704,826 | 11/1987 | Kirkland | 451/76 |
| 4,817,874 | 4/1989 | Jarzebowicz | 451/102 |
| 4,819,388 | 4/1989 | Kirkland | 451/76 |

*Primary Examiner*—David A. Scherbel
*Assistant Examiner*—Derris Holt Banks
*Attorney, Agent, or Firm*—Philip A. Dalton

[57] ABSTRACT

The useful life of a dry abrasive blasting head is greatly extended by two design features. First, the tube on which the rotating nozzles are mounted is protected from abrasion by an easily-replaced wear tube which is a sleeve-like liner. Secondly, the relatively expensive nozzle holder is protected by providing it with a cup-shaped cavity facing the incoming abrasive particles. The cup-shaped cavity soon becomes at least partially filled by the particles, so that later-arriving particles strike the particles contained in the cavity and do not directly reach the nozzle holder, thereby prolonging its life. Taken together, these structural features of the present invention result in a high-performance blasting head that can operate for more than 1,000 hours without interruption.

5 Claims, 1 Drawing Sheet

DRY ABRASIVE BLASTING HEAD HAVING ROTATING NOZZLES

This application is a continuation-in-part of U.S. application Ser. No. 08/828,139, filed Mar. 24, 1997 abandoned , which is a continuation of U.S. application Ser. No. 08/423,970, filed Apr. 18, 1995, abandoned.

BACKGROUND OF THE INVENTION

1. Field of the Invention

The present invention is in the field of dry abrasive blasting, and more particularly relates to high-performance rotating-nozzle blasting equipment.

2. The Prior Art

The present invention relates to high-performance equipment that moves along the axis of a large pipe while cleaning the interior surface of the pipe by directing a stream of air-suspended dry abrasives at the inside wall of the pipe. The equipment includes a plurality of nozzles directed obliquely outward that rotate about the axis of the pipe.

The high level of performance of the equipment can be appreciated from the fact that in one embodiment the equipment can clean pipes having diameters as large as 32 feet. The apparatus is operated by three men, and the nozzles rotate at approximately 68 revolutions per minute about the axis of the pipe. The apparatus can clean 4,000 square feet per hour to a white metal finish, meaning that all traces of rust, scale, and paint have been removed, leaving only the bare metal.

The equipment can be operated with a wide variety of abrasive particles which are discharged from the nozzles at a velocity of 14,000 feet per second. Abrasive streams of these velocities are highly destructive of the blasting machine unless the machine is specifically designed to avoid excessive wear. Such machines are expensive to operate, and because they interfere with other operations on the pipe being cleaned, it is important that the cleaning job be finished as rapidly as possible. Consequently, high reliability and minimum down-time were important considerations in the design. The present application describes several design innovations that have resulted in operating times of at least 1,000 hours without interruptions. This is clearly good performance for a machine that handles such highly abrasive streams.

In U.S. Pat. No. 2,358,557, Boyd el al. describe a blast cleaning device having a rotating nozzle head and in which the bearings of the rotating nozzle head are protected from invasion by the abrasive material through the use of a seal and bleeder ducts to prevent circulation of the pressurized air through the bearings.

In U.S. Pat. No. 5,113,885, Ramsey shows a pipe cleaning apparatus having a rotating nozzle head that is mounted in a bushing that is sealed.

In U.S. Pat. No. 5,020,188, Walton describes an apparatus for cleaning the interior of ductwork from within, but the problems addressed by the present invention are not discussed by Walton.

In U.S. Pat. No. 4,690,159, Vadakin et al. describe a rotary cleaning device that rides along a cable within the pipe to be cleaned. O-rings are used to prevent the pressurized fluid from leaking, but the problems solved by the present invention are not discussed.

In U.S. Pat. No. 3,987,963, Pacht shows a hand-held lance having a rotating sprayhead.

The equipment of the present invention combines extremely high performance with very good reliability and minimum downtime. This high degree of performance is attributable to certain design features to be discussed below, which in the light of the known prior art believed to be novel and innovative.

SUMMARY OF THE INVENTION

A foremost objective of the invention is to provide equipment that can remove rust, scale, paint, or unwanted coatings from the inside of a pipe at unprecedented speed. Specifically, the equipment of the present invention can clean 4,000 square feet per hour and can handle pipes having inside diameters ranging from several inches to 32 feet.

The dry abrasive blasting machine of the present invention uses air as a propellant and any of a number of abrasives may be used, the more common ones being aluminum oxide, steel grit, silica sand grit, copper slag and nickel slag. Particles of these materials travelling at speeds 2.65 miles per second pass through the equipment and are directed at the surface to be cleaned by the present invention. Not-surprisingly, abrasive particles travelling at these speeds can remove practically any unwanted material.

Unfortunately, this high level of performance causes serious design problems in the blasting equipment itself. The situation is analogous to the classical question regarding how to contain a universal solvent. Unless the equipment is very skillfully designed, the high speed particles will quickly erode it and cause interruption in its use.

Accordingly, a second major objective of the present invention is to provide a high performance blasting equipment that can operate for long periods of time without interruptions. The design of the present invention will permit operating times of at least 1,000 hours without interruptions.

In the preferred embodiment, several structural features combine to produce this high level of performance. In accordance with the present invention, the bearings within which the nozzle head rotates are carefully sealed to protect them from the abrasive particles.

Further, in accordance with the present invention, the rotating tube through which the abrasive particles travel to the rotating nozzle head is protected from wear by a sleeve-like liner called a wear tube. The wear tube is relatively inexpensive because it requires only minimal machining and is easy to replace, if replacement ever becomes necessary.

In accordance with the present invention, at the only location where the particles undergo an abrupt change of direction, a cup-like reservoir is provided, which rapidly fills with abrasive particles so that later-arriving particles impact the particles contained in the reservoir instead of the metal, thereby greatly reducing abrasion of the metal at this potential trouble spot.

In another aspect, vent holes are provided in the housing for venting blast media and thus protecting structures such as seals and bearings from accelerated wear.

These and other aspects of the design will be described more fully below with the help of the accompanying drawing in which a preferred embodiment of the blasting head is shown. It should be remembered, however, that the drawing is provided for the purpose of illustration and explanation only and is not intended to limit the scope of the present invention.

DETAILED DESCRIPTION OF THE PREFERRED EMBODIMENT

Figure 1:
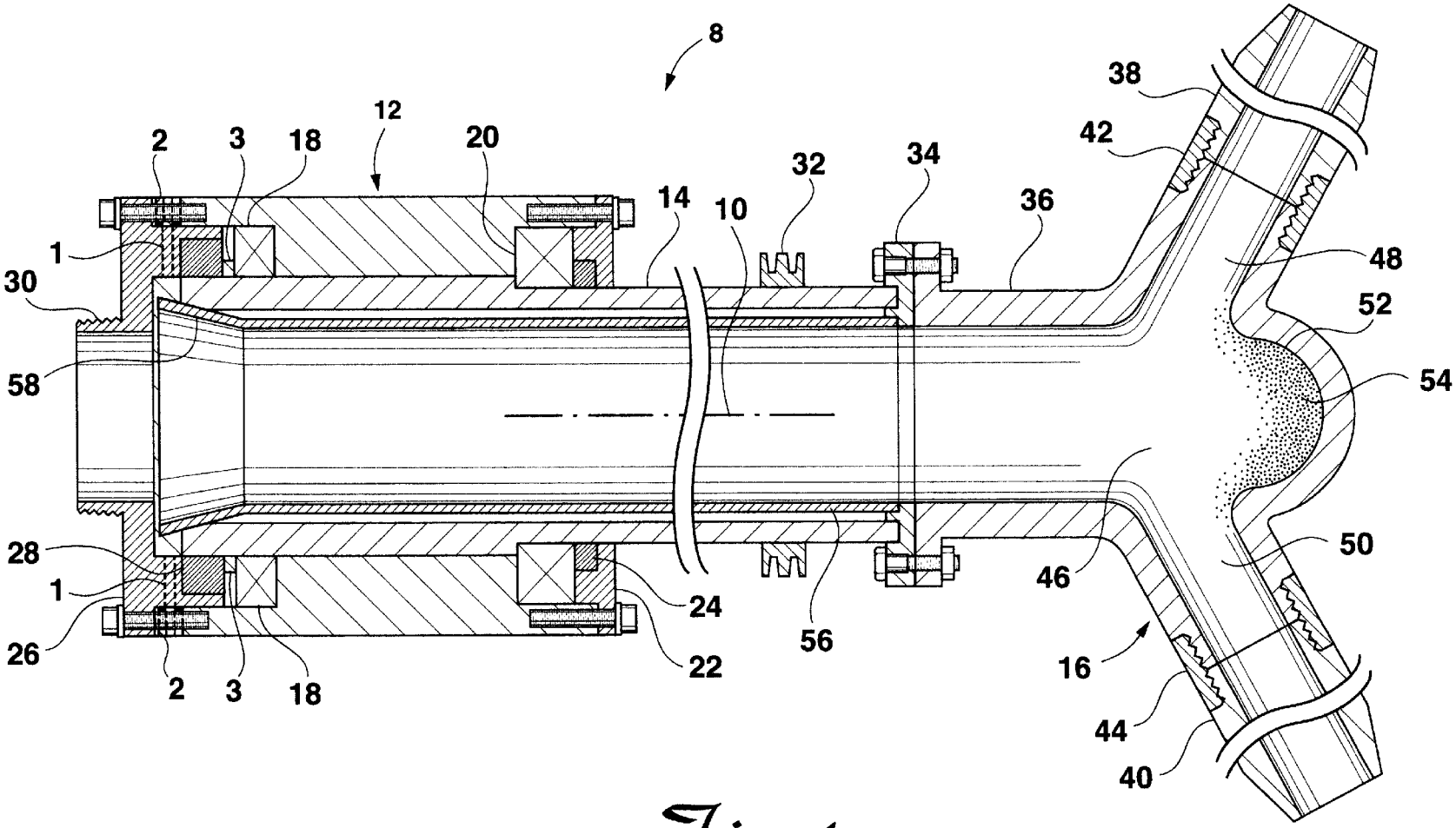
FIG. 1 is a side elevational cross-sectional view of a preferred embodiment of the blasting head of the present invention.

The blasting apparatus 8 shown in the drawing, FIG. 1, is mounted, along with other apparatus, on a powered vehicle that travels slowly along the lower inside surface of a pipe or duct. The apparatus shown in the drawing is elevated above the vehicle so that the axis of rotation 10 of the nozzle assembly 16 coincides with the axis of the pipe being cleaned.

The major components of the apparatus are a stationary housing 12, a rotating tube 14, and a nozzle assembly 16. The tube 14 is mounted for rotation within the stationary housing 12, and is coupled to the nozzle assembly 16 which rotates at approximately 68 revolutions per minute in the preferred embodiment.

More specifically, the tube 14 is mounted for rotation with respect to the stationary housing 12 by sealed bearings 18 and 20. The bearing 20 is held in place by a front end plate 22, and a seal 24 is provided to protect the bearing 20 from abrasive particles by making sealing contact with the tube 14 and the front end plate 22.

Likewise, the bearing 18 is held in place by the rear end plate 26, and a seal 28 sealingly engages the tube 14 and the rear end plate 26 to protect the bearing 18 from abrasive particles. The rear end plate 26 also includes a coupling 30 for attaching a hose through which the airborne abrasive particles enter the apparatus.

In a preferred aspect, one or more vent holes 1 are formed in the housing 12 end plate 26 adjacent (just behind) the seal 28 to vent the high pressure build-up of particles, blast media, on the inlet side of the nozzle adjacent the seal. This prevents the blast media from bypassing the seal 28 into the bearing 18 and/or from pushing the seal against the bearing. As a result, the operational life of the system between bearing or seal replacement is greatly extended. Furthermore, as shown in FIG. 1, the vent holes 1 can be enlarged at the outer end and fitted with preferably hardened inserts or collars 2, which prevent the holes 1 from being enlarged by the blast media. The collars 2 conveniently are replaced when they eventually are worn or enlarged.

Optionally, a snap ring 3 can be mounted between seal 28 and bearing 18 to assist the sealing off of the bearing from the blast media.

Illustratively, two vent holes 1 are depicted. Although for ease of illustration, vent holes are depicted at the top and bottom of the blast head, good results have been achieved by positioning a hole 1 at the bottom of the blast head 8, oriented vertically. Alternatively, two holes have been positioned at the bottom of the blast head, oriented for example along radii directed approximately 20° and 60° from the vertical. Those of usual skill in the art will readily install the vent holes in other arrangements (numbers and positions) as desired.

In another preferred aspect, the tube 14 is driven by a belt wheel 32 that is affixed to the tube 14. The belt wheel is driven by a belt that in turn is driven by a 1.0 horsepower motor that is mounted on top of the stationary housing 12. The nozzle assembly 16 is bolted to a flange 34 at the front end of the tube 14. The nozzle assembly 16 divides the stream of abrasive particles moving in the direction indicated by the arrows into a plurality of branch streams that are discharged through a plurality of nozzles. In the preferred embodiment shown in the drawing, there are two nozzles, but in alternative embodiments three or four nozzles are used.

The nozzle assembly 16 includes a nozzle holder 36, the nozzles 38 and 40, and the unions 42 and 44 by which the nozzles are attached to the nozzle holder 36. The nozzle holder 36 includes a central chamber 46 and hollow branches 48 and 50. The central chamber 46 extends forward beyond its junction with the hollow branches 48 and 50 to form a cup-shaped cavity 52 that in operation becomes filled with particles 54 that prevent later-arriving particles from reaching and abrading the cup-shaped cavity 52, thereby greatly prolonging the life of the expensive nozzle holder 36.

The tube 14 is also carefully machined and therefore relatively expensive. To avoid damage by abrasion, the tube 14 is lined by a hollow wear tube 56. The wear tube 56 is an inexpensive sleeve that is swedged at its rear end 58.

Thus, it is seen that the wear tube 56 protects the interior of the tube 14 from abrasion and can readily be replaced if necessary. The nozzle holder 36 is protected from excessive abrasion by provision of the cup-shaped cavity 52. In addition to these precautions, the bearings 18 and 20 are protected from abrasive particles by the seals 28 and 24, respectively. As a result of these structural features, the blasting head of the present invention achieves unusually long life and high performance.

The forgoing detailed description is illustrative of one embodiment of the invention, and it is to be understood that additional embodiments thereof will be obvious to those skilled in the art. The embodiments described herein together with those addition embodiments are considered to be within the scope of the invention.

What is claimed is:

1. A dry abrasive blasting head having rotating nozzles, comprising:

(a) a tube having a front end and a rear end and having a longitudinal axis about which said tube rotates;

(b) a housing, not rotating and surrounding a portion of said tube adjacent the rear end of said tube, said housing having a front end and a rear end;

(c) a front end plate attached to and closing the front end of said housing and including a hole through which said tube extends;

(d) a rear end plate attached to and closing the rear end of said housing, said rear end plate including a coupling for connecting to said rear end plate a conduit through which a high velocity stream of dry abrasive particles suspended in air is discharged into said tube in a forward direction;

(e) a front seal in sealing engagement with said front end plate and said tube;

(f) a rear seal in sealing engagement with said rear end plate and said tube;

(g) a bearing located axially between said front seal and said rear seal and supporting said tube within said housing for rotation about the longitudinal axis of said tube with a front portion of said tube extending forward of said front end plate;

(h) a nozzle holder mounted to the front end of said tube and including a central chamber and a plurality of hollow branches extending obliquely outward and forward and communicating with the central chamber, the hollow branches equally spaced circumferentially, and the central chamber extending forward beyond its juncture with the hollow branches;

(i) a plurality of nozzles each attached to one of said plurality of hollow branches for discharging from the blasting head the high velocity stream of air-suspended abrasive particles;

(j) at least one vent hole formed in the blast head behind the rear seal for venting abrasive particles; and (k) the nozzle holder further including a cup-like reservoir at the front end thereof for at least partially filling with particles during operation of the blasting head to protect the nozzle holder front end from abrasion by the high velocity stream of air-suspended particles.

2. The dry abrasive blasting head of claim 1 further comprising a wear tube removably captured within said rotatable tube, and belled at the rear end of said tube so that the stream of dry abrasive particles is confined within the wear tube.

3. The dry abrasive blasting head of claim 1, wherein the rotating tube includes an inward-extending flange proximate the front end thereof, and wherein the blasting head further comprises a wear tube removably captured within said rotatable tube between the rear end plate coupling and the inward-extending flange, the wear tube being belled at the rear end thereof so that the stream of dry abrasive particles is confined within the wear tube.

4. A dry abrasive blasting head system, comprising:

(a) a tube having a front end and a rear end and having a longitudinal axis about which said tube rotates;

(b) a fixed housing surrounding the rotatable tube adjacent the rear end of the rotatable tube, the housing having a front end and a rear end;

(c) a front end plate mounted to and closing the front end of the housing and including a hole through which the rotatable tube extends;

(d) a rear end plate attached to and closing the rear end of the housing;

(e) a front seal in sealing engagement with the front end plate and the rotatable tube;

(f) a rear seal in sealing engagement with the rear end plate and the rotatable tube;

(g) front and rear bearings located axially between the front seal and the rear seal and supporting the rotatable tube within the housing for rotation about the longitudinal axis with a front portion of the rotatable tube extending forward of the front end plate;

(h) a coupling mounted proximate the rear end plate and having a bore communicating into the interior of the rotatable tube, the coupling being adapted for receiving a hose through which a high velocity stream of dry abrasive particles suspended in air is discharged into the rotatable tube in a forward direction;

(i) a wear tube removably captured within the rotatable tube, the rear end of the wear tube being belled so that the stream of dry abrasive particles is confined within the wear tube;

(j) a nozzle holder mounted to the front end of the rotatable tube and including a central chamber and a plurality of hollow branches extending obliquely outward and forward and communicating with the central chamber;

(k) a plurality of nozzles each attached to one of said plurality of hollow branches for discharging from the blasting head the high velocity stream of air-suspended abrasive particles;

(l) the nozzle holder further including a cup-like reservoir at the front end thereof for at least partially filling with particles during operation of the blasting head to protect the nozzle holder front end from abrasion by the high velocity stream of air-suspended particles; and (m) at least one vent hole formed in the blast head behind the rear seal for venting abrasive particles.

5. The dry abrasive blasting head of claim 4, wherein the rotatable tube further includes an inward-extending flange proximate the front end thereof, and wherein the wear tube is captured within said rotatable tube between the rear end plate coupling and the inward-extending flange.

* * * * *

UNITED STATES PATENT AND TRADEMARK OFFICE

CERTIFICATE OF CORRECTION

PATENT NO. : 6,062,957
DATED : May 16, 2000
INVENTOR(S) : Edwin D. Klaft

It is certified that error appears in the above-identified patent and that said Letters Patent is hereby corrected as shown below:

Title page,
Item [56], References Cited, under U.S. PATENT DOCUMENTS insert the following:

| | | |
|---|---|---|
| -- 2,358,557 | 9/44 | Boyd, et al. |
| 3,074,098 | 1/63 | Downing |
| 3,106,491 | 10/63 | Leibner |
| 3,267,504 | 8/66 | Cook, et al. |
| 3,987,963 | 10/76 | Pacht |
| 4,690,159 | 9/87 | Vadakin, et al. |
| 4,763,376 | 8/88 | Spurlock, Jr., et al. |
| 5,002,120 | 3/91 | Boisture, et al. |
| 5,020,188 | 6/91 | Walton |
| 5,072,487 | 12/91 | Walton |
| 5,113,885 | 5/92 | Ramsey -- |

Under FOREIGN PATENT DOCUMENTS insert the following:

| | | |
|---|---|---|
| -- 2,215,803A | 9/89 | United Kingdom -- |

Signed and Sealed this

Thirtieth Day of July, 2002

*Attest:*

*Attesting Officer*

JAMES E. ROGAN
*Director of the United States Patent and Trademark Office*